US006280046B1

(12) United States Patent
Perez

(10) Patent No.: US 6,280,046 B1
(45) Date of Patent: Aug. 28, 2001

(54) ILLUMINATED ASSEMBLY FOR A HANDCUFF KEY

(76) Inventor: Albert M. Perez, 1234 Annapolis, Corpus Christi, TX (US) 78404

( * ) Notice: Subject to any disclaimer, the term of this patent is extended or adjusted under 35 U.S.C. 154(b) by 0 days.

(21) Appl. No.: 09/437,058

(22) Filed: Nov. 9, 1999

(51) Int. Cl.[7] ..... F21V 33/00

(52) U.S. Cl. ..... 362/116; 362/109; 362/206; 362/202

(58) Field of Search ..... 362/109, 116, 362/118, 202, 205, 206

(56) References Cited

U.S. PATENT DOCUMENTS 1,408,526 * 3/1922 Lyhne ..... 362/206
1,955,511 * 4/1934 Muros ..... 362/206
2,208,498 * 7/1940 Cramer ..... 362/116
2,666,894 * 1/1954 Babernitsh ..... 324/507
3,863,062 * 1/1975 Caron .
4,302,797 * 11/1981 Cooper .
4,864,474 * 9/1989 Maglica .
5,181,927 * 1/1993 Song .
5,460,022 * 10/1995 Parsons .
5,541,817 * 7/1996 Hung .
5,568,741 * 10/1996 Parsons .
5,704,236 * 1/1998 Parsons .
5,713,656 * 2/1998 Lin .
5,730,013 * 3/1998 Huang ..... 70/395
5,772,308 * 6/1998 Lin .
5,826,969 * 10/1998 Nevin .
5,845,986 * 12/1998 Breen .
5,937,680 * 8/1999 Parsons .

* cited by examiner

*Primary Examiner*—Sandra O'Shea
*Assistant Examiner*—Ismael Negron
(74) *Attorney, Agent, or Firm*—G. Turner Moller

(57) ABSTRACT

A handcuff key assembly comprises an elongate housing having means to illuminate a handcuff key at one end of the housing. The key is illuminated through a light transmitting fixture holding the key. A locking pin is provided at the opposite end of the assembly on a threaded assembly. A bulb fits in the recess of the fixture and abuts a battery. An electrical circuit energizes the bulb and includes the battery, the bulb, the housing and the locking pin assembly.

20 Claims, 1 Drawing Sheet

FIG. 1
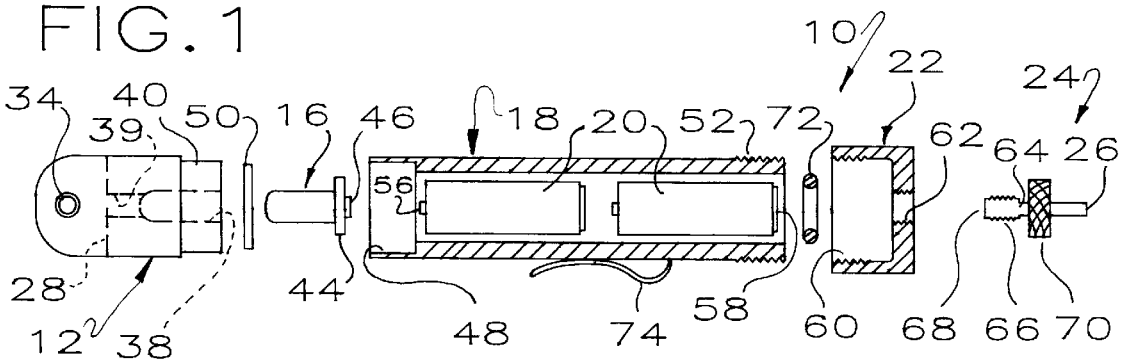
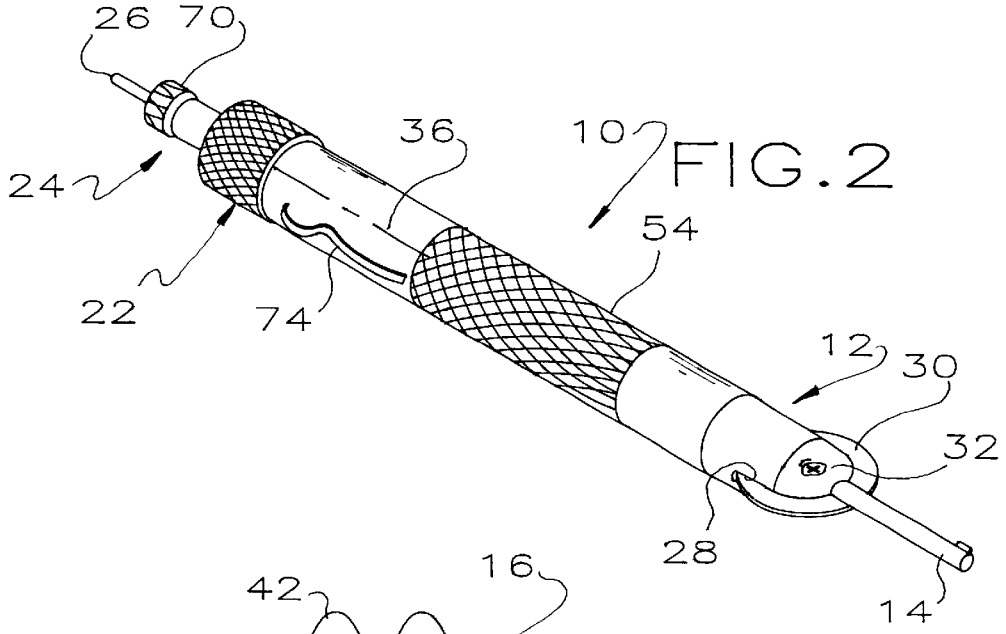
FIG. 2
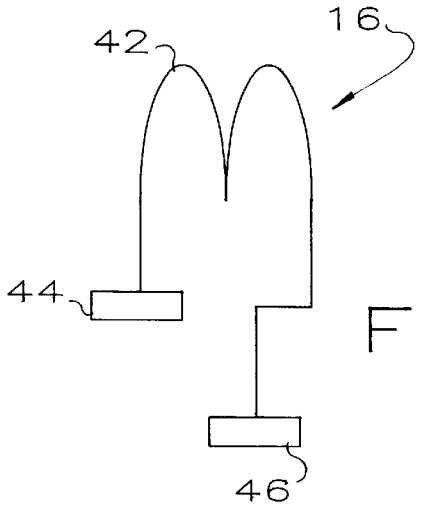
FIG. 3

ILLUMINATED ASSEMBLY FOR A HANDCUFF KEY

This invention is an illuminated handcuff key allowing police officers to illuminate a key slot on a set of handcuffs while using the key.

BACKGROUND OF THE INVENTION

Police officers routinely handcuff and remove handcuffs from suspects, during daylight and at night. Conventional handcuffs include a pair of arms that latch together when one arm is telescoped inside the other. A second locking mechanism includes a slot on the side of the handcuffs that exposes a latching element. To double lock the handcuffs, a locking pin is required to pass through the slot and manipulate the latching element. A standard locking pin is about 0.10" in diameter and at least about 0.25" long.

Although the procedures of police departments differ, it is considered sound practice to double lock the handcuffs on anyone being transported for a substantial distance or time. A transporting officer sometimes discovers that a suspect has a standard handcuff key and is surprised to find the person uncuffed. An unattended handcuffed person with a handcuff key can unlock a set of handcuffs even if the double lock is locked.

To remove a standard handcuff that is single or double locked, a standard handcuff key is required. The standard handcuff key is L-shaped with relatively sharp corners and edges and can be used to unlock any set of standard handcuffs. To unlock single locked handcuffs, the key is inserted in the key slot and turned counter-clockwise. This unlocks a single locked standard handcuff.

To remove double locked handcuffs, the standard handcuff key is inserted in the key slot and turned clockwise. This releases the double lock mechanism. The office then turns the key counter-clockwise to unlock the single lock mechanism thereby releasing the cuff. This is done on each cuff to remove the handcuffs.

A typical officer has a handcuff key that includes a locking pin, generally loose in a pocket or on a key ring. The key and pin are easy to lose or misplace, particularly when handled at night because they can be dropped and thereby disappear.

Disclosures relevant to the disclosure of this invention are found in U.S. Pat. Nos. 3,863,062; 4,302,797; 4,864,474; 5,181,927; 5,460,022; 5,541,817; 5,568,741; 5,704,236; 5,713,656; 5,772,308; 5,730,013; 5,826,969; 5,845,986 and 5,937,680.

SUMMARY OF THE INVENTION

In this invention, a handcuff key and a locking pin are provided on an assembly which includes means for illuminating the key. The assembly provides a simple and expeditious technique for holding the handcuff key and locking pin and preferably includes a clip so the assembly can be carried in a pocket, in a manner analogous to a pen.

Construction of the assembly is simple. A metallic tube provides a housing receiving a light transmitting fixture at one end. The fixture provides a slot for receiving the handcuff key and a fastener secures the key to the fixture. A locking pin is provided at the opposite end of the housing. The locking pin is part of a threaded member, acting as a switch, which is advanced into the housing to complete an electric circuit to a bulb thereby illuminating the key.

The electric circuit energizing the bulb is simplicity itself. The bulb fits in a recess in the light transmitting fixture and abuts a washer making electrical connection to the housing. One or more batteries are located inside the housing and one abuts a terminal on the end of the bulb. At the locking pin end of the assembly, a threaded cap allows access to the batteries to remove and replace them as needed. A resilient grommet is inside the housing and is compressed by the threaded cap to prevent the batteries and bulb from rattling. When one wants to light the handcuff key, one threadably advances the locking pin so it contacts the end of the battery. This completes an electric circuit energizing the bulb.

It is an object of this invention to provide an improved handcuff key assembly.

A further object of this invention is to provide an illuminated handcuff key assembly including a locking pin for double locking a pair of handcuffs and unlocking the double lock.

Another object of this invention is to provide an handcuff key assembly providing a simple reliable electric circuit for illuminating the handcuff key.

These and other objects and advantages of this invention will become more apparent as this description proceeds, reference being made to the accompanying drawings and appended claims.

BRIEF DESCRIPTION OF THE DRAWINGS

FIG. 1 is an exploded cross-sectional view of a handcuff key assembly of this invention;

FIG. 2 is an isometric view of a handcuff key assembly of FIG. 1;

FIG. 3 is a schematic view of a bulb used in this invention.

DETAILED DESCRIPTION

Referring to FIGS. 1–2 a handcuff key assembly 10 of this invention comprises, as major components, a light transmitting fixture 12 for receiving a handcuff key 14, a bulb 16, a housing 18 providing a chamber for receiving one or more batteries 20 therein, a removable end cap 22 providing access to the batteries 20 and an on-off switch 24 providing a locking pin 26. In addition to providing a light for illuminating the key 14, the handcuff key assembly 10 may be used as a small flashlight.

The fixture 12 is preferably made of a transparent or translucent electrically insulating plastic material such as clear polyurethane and includes a slot 28 receiving the flattened head 30 of the handcuff key 14. A threaded fastener 32 extends through a passage 34 in the fixture 12 and secures the key 14 in place, coaxial with a central axis 36 of the assembly 10. As shown in FIG. 2, the fixture 12 includes an enlarged recess 38 for receiving the bulb 16 and a small passage 39 interconnecting the recess 38 and the slot 28, for purposes more fully apparent hereinafter. The fixture 12 provides a cylindrical end 40 connecting to the housing 18 in any suitable manner.

As shown in FIGS. 1 and 3, the bulb 16 is of a conventional design including a filament 42 having an end connected to a rim or flange 44 and an end connected to a central terminal 46 which is insulated from the rim 44 and connected electrically only by the filament 42.

The housing 18 is made of an electrically conductive material, preferably a metal such as aluminum or the like, and provides a recessed end 48 receiving the end 40 of the fixture 12. A washer 50 of an electrically conductive material, such as metal, is provided between the fixture 12 and the housing 18 and preferably seats in the recessed end 48 of the housing 18. Preferably, the fixture 12 and housing 18 are glued together and thereby captivate the washer 50 in electrical communication with the housing 18. It will be seen that the bulb 16 extends into the recess 38 until the rim 44 abuts the washer 50. The washer 50 accordingly acts as an electrical conductor between the rim 44 and the housing 18. The housing 18 includes external threads 52 for receiving the end cap 22. Conveniently, the housing 18 has exterior knurling 54 providing a better gripping surface.

The batteries 20 are of a conventional cylindrical type providing a positive terminal 56 at one end and a negative terminal 58 at the other. Preferably, a battery assembly is provided in which two or more similar batteries are used mounted so the positive terminal 56 of one battery abuts the negative terminal 58 of the adjacent battery.

The end cap 22 includes threads 60 mating with the threads 52 and a central threaded opening 62 for receiving the switch 24.

The switch 24 includes a body 64 having an exteriorly threaded section 66 received in the threaded opening 62 of the end cap 22 and an end 68 for engaging the terminal 58 of the nearest battery 20. The switch 24 includes a knurled knob 70 for turning the switch 24. The locking pin 26 extends away form the knob 70 coaxial with the axis 36. The switch 24 accordingly doubles as a locking pin assembly.

A rubber grommet 72 is provided inside the housing 18 to press the batteries 20 against the bulb 16 and prevent them from rattling. The grommet 72 may fit tightly inside the housing 18 or may be pressed by the end cap 22 for this purpose. The grommet 72 may be of any suitable type and is conveniently an O-ring. It will be evident that the batteries 20 and the bulb 16 are unconnected to any component inside the housing 18 thereby providing a simple and inexpensive device.

Assembly of the handcuff key assembly 10 of this invention should now be apparent. The standard handcuff key 14 also includes a locking pin (not shown). When the key 14 is inserted into the slot 28, the locking pin extends into the passage 39. This prevents the key 14 from rotating about the axis of the fastener 32 and thereby stabilizes the key 14, even if the fastener 32 is slightly loose. To remove or replace the components inside the housing 18, the end cap 22 is unscrewed and the grommet 72 is removed thereby allowing batteries 20 and/or the bulb 16 to be removed and replaced. With a bulb 16 and batteries 20 inside the housing, the grommet 72 is placed in the open end of the housing 18 and the end cap 22 threaded onto the housing 18.

Operation of the handcuff key assembly 10 of this invention should now be apparent. The bulb 16 is normally not lit. Thus, the switch 24 is normally out of contact with the terminal 58 of the battery 20. When it is desired to turn the bulb 16 on, the knob 70 is turned to threadably advance the body 64 into the battery chamber. When the end 68 of the switch 24 contacts the terminal 58, an electric circuit is completed through the bulb 16 thereby illuminating the key 14. The electric circuit includes the rim 44 of the bulb 16, the washer 50, the housing 18, the end cap 22, the switch 24, the batteries 20, the bulb terminal 46 and the filament 42. To turn off the bulb 16, the switch 24 is rotated in the opposite direction thereby retracting the end 68 of the switch out of contact with the battery terminal 58.

A police officer is accordingly able to illuminate the key end of the assembly 10 and see the key 14 in order to unlock a pair of handcuffs. Because the locking pin 26 is on the opposite end of the assembly 10, a pair of handcuffs can readily be double locked, or the double lock unlatched. The assembly 10 gives off a substantial amount of light thereby allowing an officer to use it in a conventional manner as a small flashlight.

The handcuff key assembly 10 also comprises a clip 74 for attaching the handcuff key assembly to the pocket of a user.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. An illuminated handcuff key comprising an electrically conductive housing having a chamber for receiving a battery assembly;

a handcuff locking pin exterior of the housing;

a light transmitting fixture connected to a first end of the housing and having means for connecting a handcuff key thereto and a recess;

an electrical connection extending from the fixture, adjacent the recess, to the housing;

an illuminating bulb, in the recess, having a rim abutting the electrical connection, a bulb terminal, facing the chamber, electrically insulated from the rim for abutting and making electrical contact with a first end terminal of the battery assembly, and an illuminating filament having a first end electrically connected to the rim and a second end electrically connected to the bulb terminal;

a removable cap on a second end of the housing allowing removal and replacement of the battery assembly;

a switch comprising a threaded end extending through the removable cap and normally out of engagement with the battery assembly and movable toward the battery assembly, for contacting a second end terminal of the battery assembly and completing an electrical circuit including the battery assembly, the filament, the threaded end and the housing, and a body portion exterior of the housing so a user can grip the body portion and threadably advance the threaded end into the housing for abutting the battery assembly and completing an electric circuit energizing the bulb; and means independent of the switch immobilizing the battery assembly in a position in constant contact with the bulb.

2. The handcuff key of claim 1 wherein the electrical connection comprises an electrically conductive washer between the fixture and the rim.

3. The handcuff key of claim 1 wherein the housing comprises an elongate central axis and the key connecting means comprises means for attaching a handcuff key to the fixture coaxial with the central axis.

4. The handcuff key of claim 1 wherein the battery assembly includes at least two batteries in the housing.

5. The handcuff key of claim 1 wherein the housing comprises a tubular member having a central axis and the locking pin is on the body portion parallel to the central axis.

6. The handcuff key of claim 5 wherein the locking pin is coaxial with the central axis.

7. The handcuff key of claim 1 wherein the key connecting means comprises a slot in the fixture.

8. The handcuff key of claim 7 wherein the light transmitting fixture comprises a passage extending between the recess and the slot for receiving a locking pin of a standard handcuff key.

9. The handcuff key of claim 7 further comprising a clip on the exterior of the housing for attaching the handcuff key to the pocket of a user.

10. The handcuff key of claim 1 wherein the immobilizing means comprises a resilient member between the battery assembly and the removable cap.

11. The handcuff key of claim 10 wherein the resilient member comprises an annulus providing a central opening allowing movement of the threaded end therethrough into electrical connection with the second end terminal of the battery assembly for completing the electric circuit.

12. The handcuff key of claim 11 wherein the resilient member is an O-ring.

13. An illuminated handcuff key comprising an electrically conductive housing having a chamber for receiving a battery assembly;

a light transmitting fixture connected to a first end of the housing and having means for connecting a handcuff key thereto and a recess;

a handcuff locking pin exterior of the housing;

an electrical connection extending from the fixture, adjacent the recess, to the housing;

an illuminating bulb, in the recess, having a rim abutting the electrical connection, a bulb terminal, facing the chamber, electrically insulated from the rim for abutting and making electrical contact with a first end terminal of the battery assembly, and an illuminating filament having a first end electrically connected to the rim and a second end electrically connected to the bulb terminal; and a switch comprising a threaded end extending into the housing for contacting a second end terminal of the battery assembly and completing an electrical circuit including the battery assembly, the filament, the threaded end and the housing, a body portion exterior of the housing so a user can grip the body portion and threadably advance the threaded end into the housing for abutting the battery assembly and completing an electric circuit energizing the bulb.

14. The handcuff key of claim 13 further comprising a removable cap on a second end of the housing allowing removal and replacement of the battery assembly, the threaded end of the switch extending through the end cap; and means, independent of the switch, pressing the battery assembly and the bulb together.

15. An illuminated handcuff key comprising a housing having a chamber for receiving a battery assembly;

a handcuff locking pin exterior of the housing;

a handcuff key adjacent a first end of the housing and having a handcuff locking projection thereon;

an illuminating bulb adjacent the first end of the housing casting light toward the handcuff key for illuminating the handcuff key; and means including a switch for completing a circuit between the battery assembly and the bulb.

16. The illuminated handcuff key of claim 15 further comprising a light transmitting fixture connected to a first end of the housing having a slot spaced from the first housing end for receiving one end of the handcuff key therein, means for connecting the handcuff key in the slot and a passage extending from the slot toward the first housing end for receiving a locking pin of a handcuff key.

17. The illuminated handcuff key of claim 16 wherein the light transmitting fixture provides a recess receiving the bulb.

18. The illuminated handcuff key of claim 16 wherein the locking pin extends away from the housing adjacent an end opposite the first housing end.

19. The illuminated handcuff key of claim 15 wherein the locking pin is rigid with the housing.

20. The illuminated handcuff key of claim 19 wherein the locking pin extends from a second end of the housing, opposite from the first end.

* * * * *